US006827122B2

(12) United States Patent
Lai

(10) Patent No.: US 6,827,122 B2
(45) Date of Patent: Dec. 7, 2004

(54) MOLD AND METHOD FOR PRODUCING A TWO-STROKE ENGINE CASING OF A RADIO CONTROL MODEL

(75) Inventor: Aling Lai, Taichung (TW)

(73) Assignee: Thunder Tiger Corporation, Taichung (TW)

( * ) Notice: Subject to any disclaimer, the term of this patent is extended or adjusted under 35 U.S.C. 154(b) by 65 days.

(21) Appl. No.: 10/338,197

(22) Filed: Jan. 9, 2003

(65) Prior Publication Data

US 2004/0134635 A1 Jul. 15, 2004

(51) Int. Cl.[7] ..... B22D 17/08; B22D 17/20; B22D 33/04

(52) U.S. Cl. ..... 164/113; 164/137; 164/302; 164/312; 164/340

(58) Field of Search ..... 164/113, 137, 164/302, 312, 340, 369

(56) References Cited

U.S. PATENT DOCUMENTS 5,018,568 A * 5/1991 VanRens ..... 164/34

* cited by examiner

*Primary Examiner*—Kuang Y. Lin
(74) *Attorney, Agent, or Firm*—Rosenberg, Klein & Lee

(57) ABSTRACT

A mold and method for producing a two-stroke engine casing of a radio control model are to define a core cavity and a main cavity in the mold. A first core has a first end inserted into the mold and the core cavity is defined around the first end of the first core for forming a core and simplifying the manufacturing processes. The first core with the core is inserted into the main cavity to from the cylinder of the engine and the blocks of the core define grooves in the inner periphery of the cylinder of the engine.

7 Claims, 6 Drawing Sheets

MOLD AND METHOD FOR PRODUCING A TWO-STROKE ENGINE CASING OF A RADIO CONTROL MODEL

BACKGROUND OF THE INVENTION

1. Field of the Invention

The present invention relates to a mold and method for producing a two-stroke engine casing, and more particularly to a mold and method for producing a two-stroke engine casing of a radio control model.

2. Description of Related Art

A conventional method for producing a two-stroke engine casing of a radio control model requires a core (71) to be separately received in a cavity (not shown) in a mold (not shown) for forming a cylinder in the engine casing. For forming three grooves in an inner periphery of the cylinder, with reference to FIG. 7, the core (71) has three channels (72) defined therein and extending to an outer periphery of the core (71). The three channels (72) respectively receive a first rod (73), a second rod (74) and a third rod (75). The first rod (73) has a first block (731) formed on an outer periphery of the first rod (73) and extending through the channel (72) in the core (71). The second rod (74) has a second block (741) formed on an outer periphery of the second rod (74) and extending through the channel (72) in the core (71). The third rod (75) has a third block (751) formed on an outer periphery of the third rod (75) and extending through the channel (72) in the core (71).

In molding, the core (71) with the first rod (73), the second rod (74) and the third rod (75) and other auxiliary cores (not shown) tire received in the mold and the melted material is injected into the mold. An engine casing is formed after the melted material is cooled and released from the mold. The core (71) and the rods (73, 74, 75) must be dipped in releasing agent because the core (71) and the rods (73, 74, 75) must be taken away from the engine casing. For a good releasing effect, the core (71) and the rods (73, 74, 75) are preheated to a high temperature before being dipped into the releasing agent. However, the above conventional mold and method has several disadvantages as follows.

1. The blocks (731, 741, 751) each has its own shape different from one another such that the blocks (731, 741, 751) need to be marked to prevent the blocks (731, 741, 751) from being mismatched, To mark the blocks (731, 741, 751) is trivial yet time consuming work which extends manufacturing time.
2. The rods (73, 74, 75) and the blocks (731, 741, 751) need to be preheated for good releasing effect, but the rods (73, 74, 75) and the blocks (731, 741, 751) are hard to mount in the mold when hot. The gain in releasing effect is diminished and the manufacturing time extended, where the rods (73, 74, 75) and the blocks (731, 741, 751) need to be cooled down for mounting.
3. The core (71) and the rods (73, 74, 75) are sequentially removed from the mold. However, the rods (73, 74, 75) are still engaged to the engine casing when the core (71) is removed from the mold. It is difficult to remove the rods (73, 74, 75) from the engine casing because the cylinder of the engine casing is usually of a small diameter, making cumbersome the removal of (the rods and their blocks (731, 741, 751) therethrough, With regard to the above disadvantages, an improved mold and method for producing an engine casing is provided. With reference to FIG. 8, the mold includes a first core (81) having three grooves (82) defined in an outer periphery of the first core (81) and a hole (810) defined in a bottom of the first core (81). A second core (83) remains engaged with the first core (81) during molding. The second core (83) includes a stub (830) selectively received in the hole (810) in the first core (81), and three connectors (831) radially integrally extending from the stub (830) and selectively received in a corresponding one of the three grooves (82) in the first core (81). Each connector (831) has a block (832, 833, 834) integrally connected to a free end of a corresponding one of the three connectors (831).

The first core (81) is removed from the mold after molding. The blocks (832, 833, 834) automatically detach from the inner periphery of the cylinder when the connectors (831) are broken after the first core (81) is removed from the mold. Consequently, the manufacturing process and the releasing process are simplified. However, the problems relating to mounting the heated cores (81, 82) in the mold still have not been solved.

The present invention has arisen to mitigate and/or obviate the disadvantages of the conventional molds and methods for producing a two-stroke engine casing of a radio control model.

SUMMARY OF THE INVENTION

The main object of the present invention is to provide an improved mold and method for producing a two-stroke engine casing of a radio control model.

To achieve the object, the mold and method for producing a two-stroke engine casing of a radio control model in accordance with the present invention include defining a core cavity and a main cavity in the mold. A first core has a first end inserted into the mold and, the core cavity is defined around the first end of the first core for forming a core, simplifying the manufacturing processes. The first core with the core is then inserted into the main cavity to form the cylinder of the engine and blocks formed on the core define grooves in the inner periphery of the cylinder of the engine.

Further benefits and advantages of the present invention will become apparent after a careful reading of the detailed description with appropriate reference to the accompanying drawings.

DETAILED DESCRIPTION OF THE INVENTION

Figure 1:
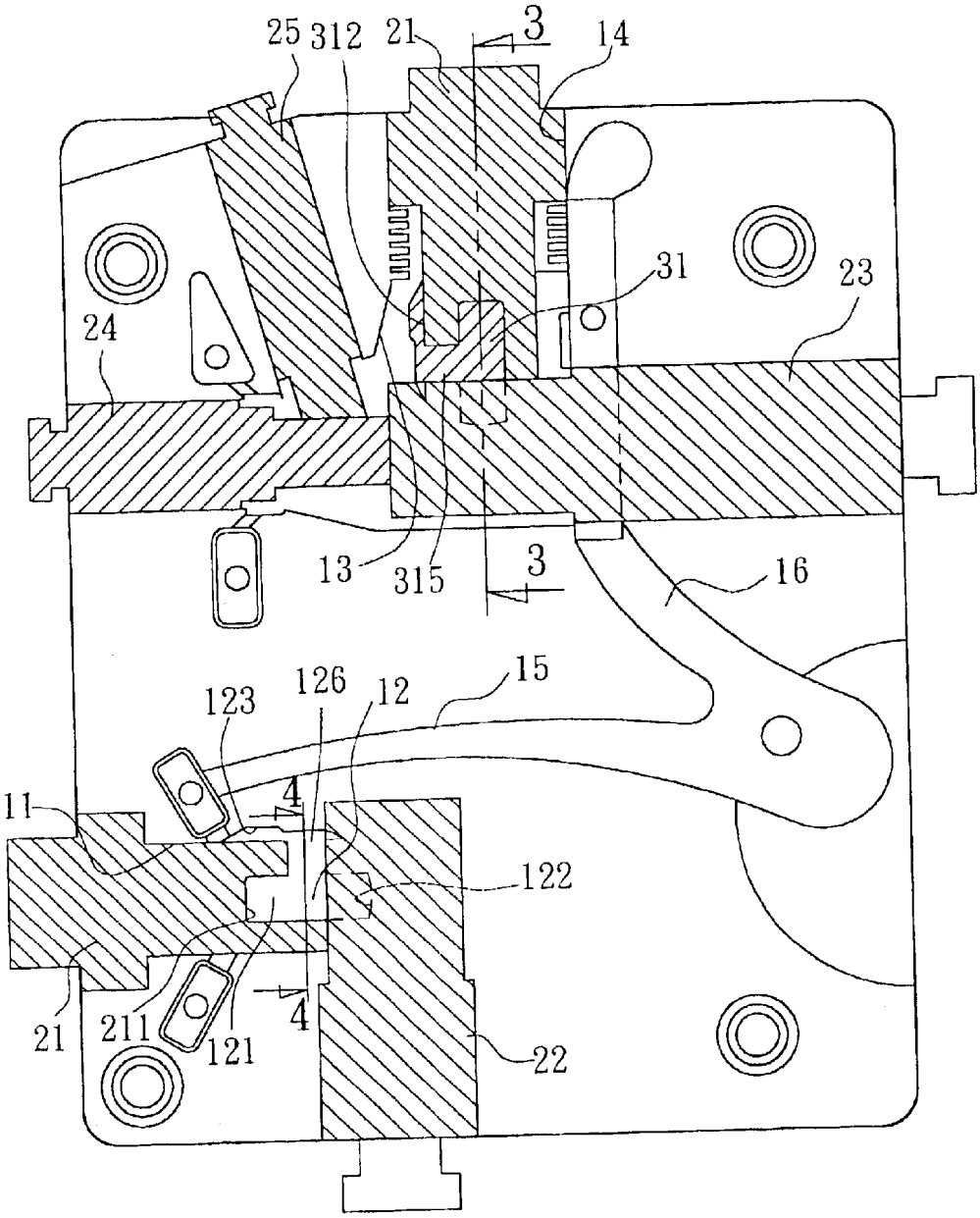
FIG. 1 is a side cross sectional view of a mold for producing a two-stroke engine casing of a radio control model in accordance with the present invention.

Referring to the drawings and initially to FIGS. 1–3 and 5, a mold for producing a two-stroke engine casing of a radio control model in accordance with the present invention comprises a first core cavity (11) laterally defined in the mold for detachably receiving a fist core (21). The first core (21) has a groove (211) defined in one end of the first core (21) received in the mold.

Figure 4:
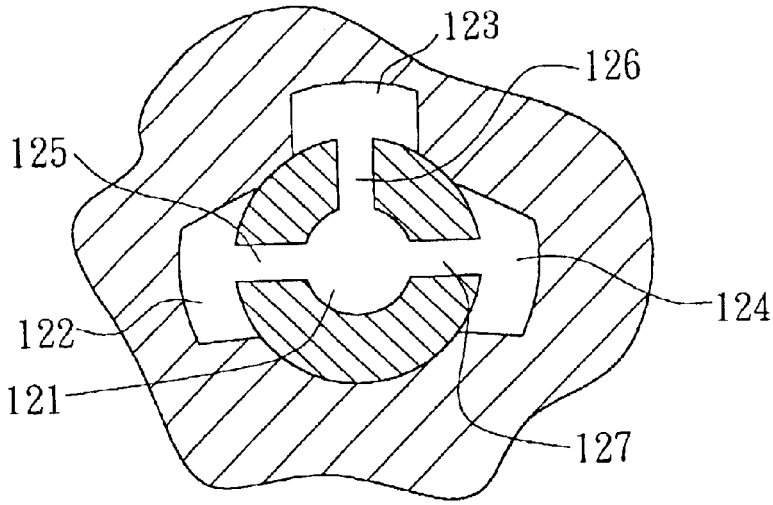
FIG. 4 is a partial front cross sectional view of the mold along the line 4—4 in FIG. 1.

A core cavity (12) is defined in the mold to communicates with the first core cavity (11) and the groove (211) in the first core (21) for foiling a core (31). The core cavity (12) has a connecting portion (121) extending to communicate with the groove (211) in the first core (21). Further, with reference to FIG. 4, the core cavity (12) includes three recesses (122, 123, 124) defined in an inner periphery of the core cavity (12) and three channels (125, 126, 127) each defined to communicate with a corresponding one of the three recesses (122, 123, 124) in the core cavity (12). The core (31) includes a stub (310) formed in the connecting portion (121), three connectors (314, 315, 316) respectively integrally extending from the stub (310) and respectively formed in a corresponding one of the three channels (125, 126, 127) and three blocks (311, 312, 313) each integrally formed on a free end of a corresponding one of the three connectors (314, 315, 316) and within a corresponding one of the three recesses (122, 123, 124) in the core cavity (12).

A second core (22) is detachably received in the mold and extends to the core cavity (12) to make the bottom of the core (31) haven concave shape. A main cavity (13) is defined in the mold and the engine casing is formed in the main cavity (13). A second core cavity (14) is defined in the mold to longitudinally communicate with the main cavity (13) for allowing the first core (21) with the core (31) to extend into the main cavity (13) to form a cylinder in the engine casing. The core (31) is longitudinally connected to a bottom of the first core (21) during molding to define grooves in an inner periphery of the cylinder of the engine casing with the blocks (311, 312, 313).

A third core (23) is detachably mounted in the moll and extends into the main cavity (13) for forming a space to receive the crankshaft of the engine. A fourth core (24) is detachably mounted in the mold, which extends into the main cavity (13) and is longitudinally connected to the third cote (23) for forming a space to receive the crankshaft of the engine. A fifth core (25) is detachably mounted in the mold, which extends into the main cavity (13) and is connected to the fourth core (24) for forming an intake of the engine. A first sprue (15) is defined in the mold and communicates with the core cavity (12) for injecting melted material into the core cavity (12) to form the core (31). A second sprue (16) is defined in the mold. The second sprue (16) communicates with the first sprue (15) and the main cavity (13) for injecting melted material into the main cavity (13) to form the engine casing.

As described above, the core (31) is connected to the first core (21) after molding such that the process of combining the core and the rods of conventional methods for producing an engine casing is omitted from the method in accordance with the present invention. Consequently, the manufacturing process of producing engine casings has been simplified.

Figure 2:
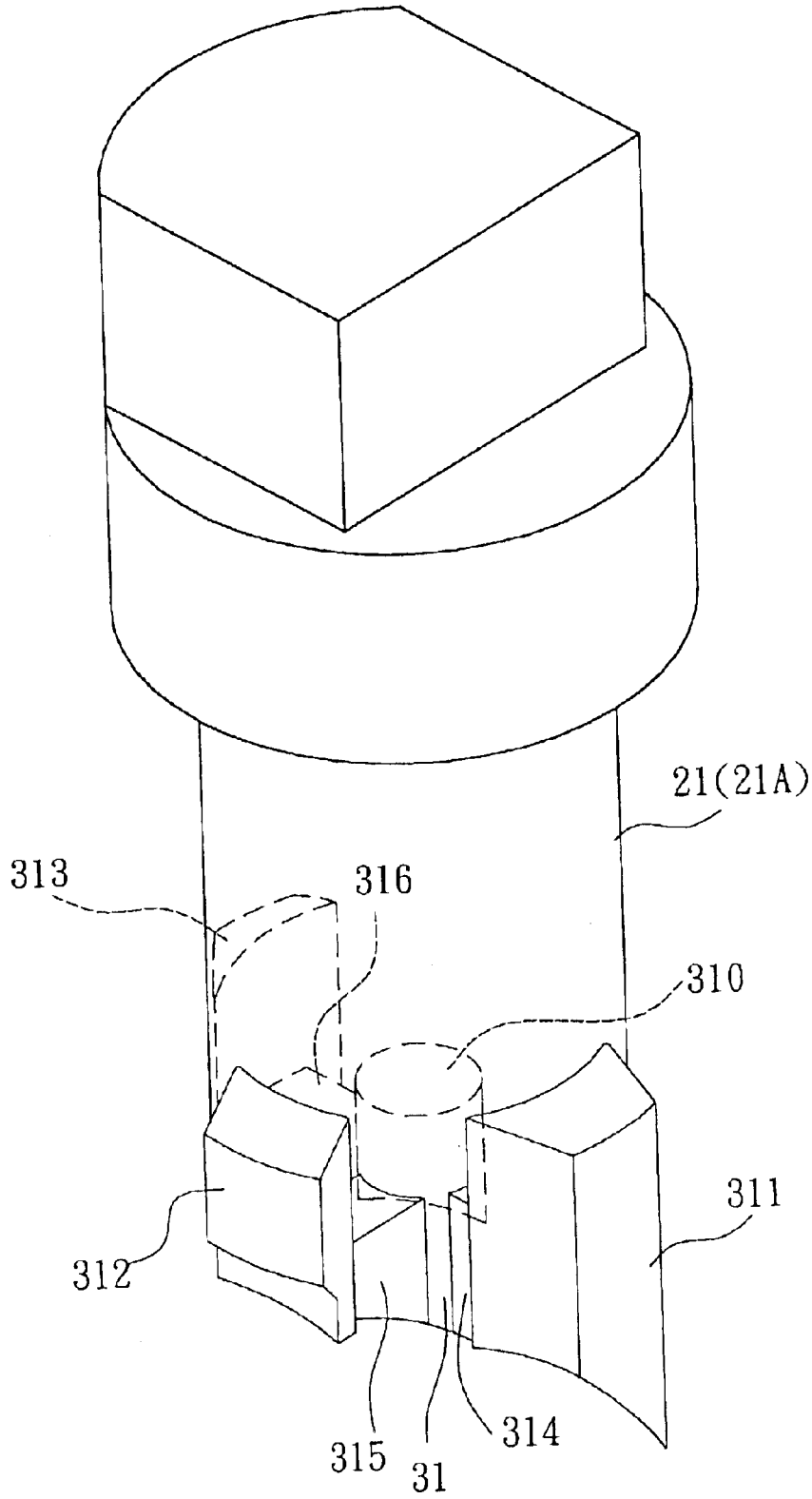
FIG. 2 is a perspective view of the first core and the sixth core of the mold in FIG. 1.
Figure 3:
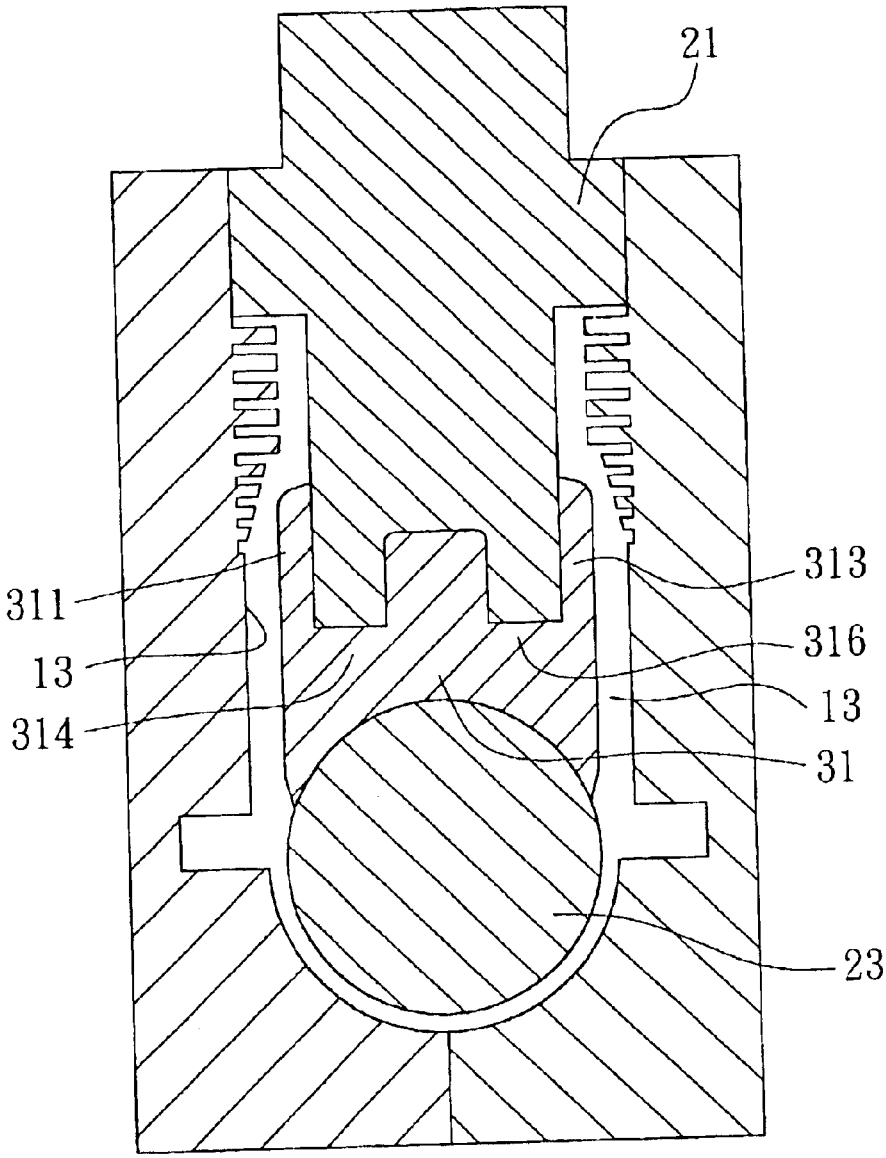
FIG. 3 is a partial front cross sectional view of the mold along the line 3—3 in FIG. 1.

In using the mold of the present invention to mold an engine casing, the manufacturer must prepare two first cores (21A, 21B). The first core (21A) is previously dipped in releasing agent and installed into the core cavity (12) with the second core (22), and melted material is injected into the core cavity (12) to form a core (31) that is connected to the first core (21A) as shown in FIG. 2. The main cavity (13) is preheated when the melted material is injected into the core cavity (12).

Figure 5:
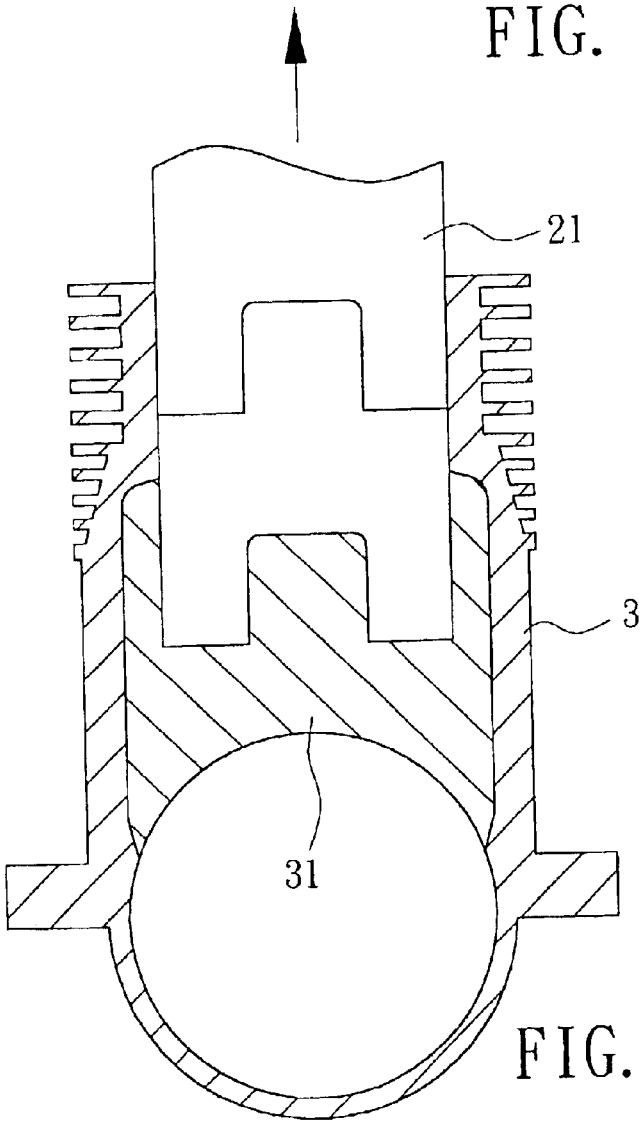
FIG. 5 is an operational front cross sectional view when removing the first core.

With reference to FIG. 5, the first core (21A) with the core (31) and the other first core (21B) are dipped into the releasing agent. Then, the first core (21A) with the core (31) and the other first core (21B) are respectively mounted in the second core cavity (14) and the first core cavity (11). The melted material is injected into the core cavity (12) and the main cavity (13) via the first sprue (15) and the second sprue (16) after the second core (22), the third core (23), the fourth core (24) and the fifth core (25) are respectively inserted into the mold. The mold is opened after the temperature of the melted material cools down and the engine casing (3) is shaped in the main cavity of the mold. Then, another core (31) is shaped in the core cavity (12) and connected to the first core (21B), the first core (21A) is removed from the second core cavity (14), such that the core (31) remains in the engine casing (3) as shown in FIG. 5. The first core (21B) is connected to a core (31) that is shaped in the core cavity (12) in this injecting process. The first core (21B) with the core (31) is dipped into releasing agent for the next injecting process after being inserted into the second core cavity (14). The first core (21A) removed from the second core cavity (14) is again dipped into releasing agent for the next injecting process after being inserted into the core cavity (12).

The shaped engine casing (3) with the core (31) is moved to the next workstation to break the connectors (314, 315, 316), whereby the blocks (311, 312, 313) are detached from the inner periphery of the cylinder for removal from the grooves formed in that inner periphery of the cylinder of the engine casing.

Figure 6:
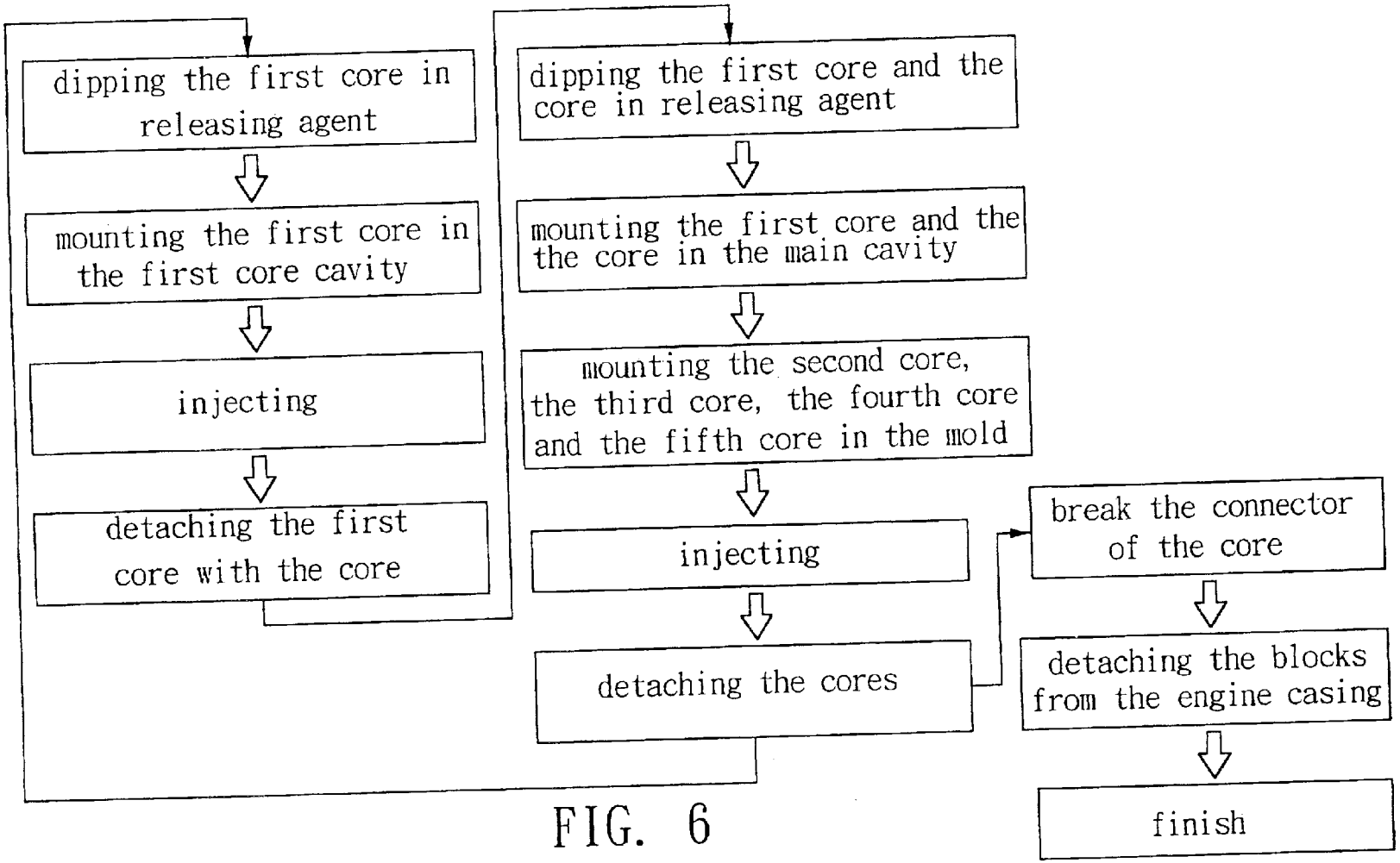
FIG. 6 is a flow chart of the method for producing a two-stroke engine casing of a radio control model in accordance with the present invention.
Figure 7:
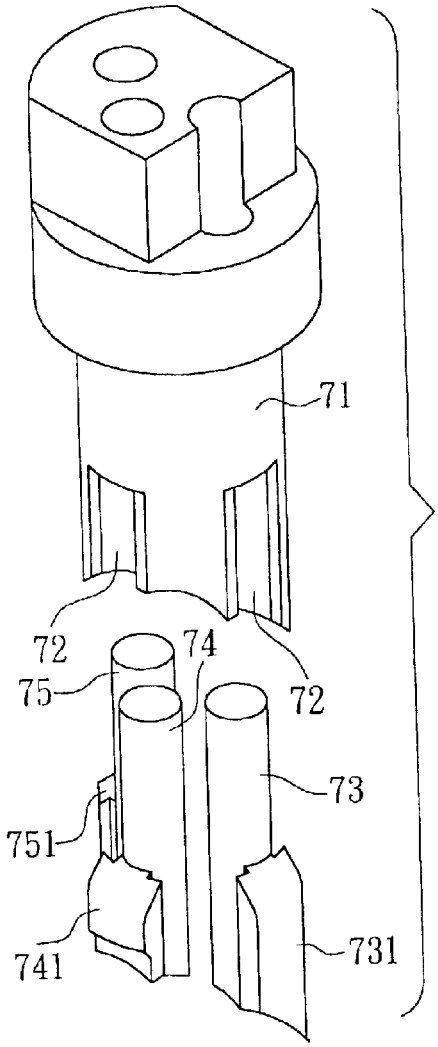
FIG. 7 PRIOR ART
FIG. 7 is a perspective view of a core and rods with blocks of a conventional mold for producing a two-stroke engine casing of a radio control model in accordance with the prior art.
Figure 8:
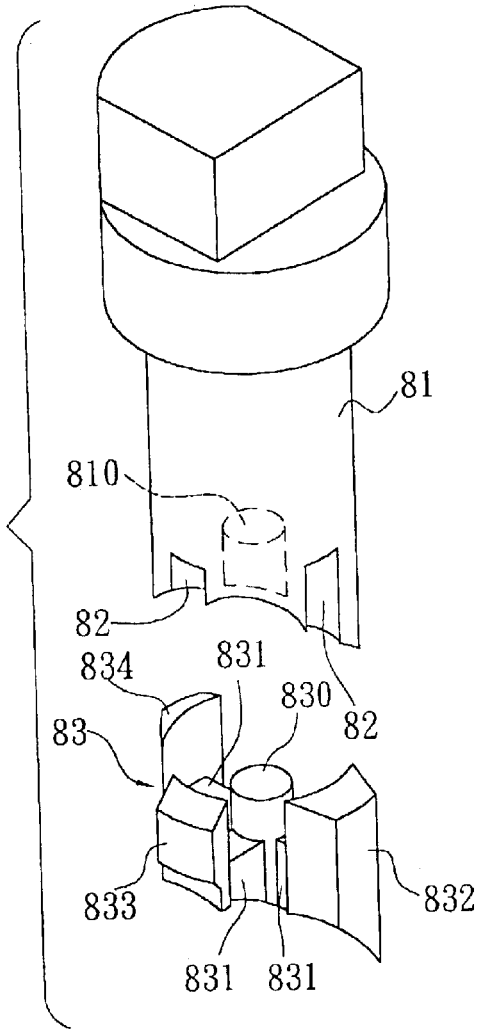
FIG. 8 PRIOR ART
FIG. 8 is a perspective view of a first core and a second core of another conventional mold for producing a two-stroke engine casing of a radio control model in accordance with the prior art.

The reference to FIG. 6, to order the above processes of molding, the method for producing a two-stroke engine casing of a radio control model comprises the steps as follows.

1. Dipping a first core in a releasing agent;
2. Mounting the first core in a first core cavity to define a core cavity;
3. Injecting a melted material to form in the core cavity a core including blocks and connectors connecting the respective blocks;
4. Detaching the first core with the core from the core cavity;

Dipping the first core and the core in the releasing agent;

6. Mounting the first core and the core in a main cavity to define an engine casing forming space.
7. Injecting the melted material into the space in the main cavity to form the engine casing;
8. Detaching the first core from the core;
9. Breaking the connectors of the core;
10. Detaching the blocks from the engine casing.

As described above, the steps 1–4 and the steps 5–9 are executed at the same time such that the manufacturing processes are effectively simplified and the cores are easily mounted in the mold even at high temperature.

Although the invention has been explained in relation to its preferred embodiment, it is to be understood that many other possible modifications and variations can be made without departing from the spirit and scope of the invention as hereinafter claimed.

What is claimed is:

1. A mold for producing a two-stroke engine casing of a radio control model, comprising:

a first core cavity defined in the mold for detachably receiving a first core corresponding in shape to a cylinder of an engine, the first core having a groove defined in an end thereof received in the mold;

a core cavity defined in the mold and communicating with the first core cavity and the groove of the first core for forming a core with three blocks radially extending therefrom;

a second core detachably received in the mold and extending to the core cavity to define for a bottom of the core a concave shape;

a main cavity defined in the mold having a space for shaping the engine casing;

a second core cavity defined in the mold and longitudinally communicating with the main cavity for allowing the first core with the core to extend into the main cavity and adapted to form the cylinder in the engine casing and the three blocks of the core each adapted to define a groove in an inner periphery of the cylinder;

a third core detachably mounted in the mold and extending into the main cavity and adapted to form a space for receiving a crankshaft of the engine;

a fourth core detachably mounted in the mold and extending into the main cavity, the fourth core longitudinally connected to the third core and adapted to form the space for receiving the crankshaft of the engine;

a fifth core detachably mounted in the mold and extending into the main cavity, the fifth core connected to the fourth core and adapted to form an intake of the engine;

a first sprue defined in the mold and communicating with the core cavity for injecting a melted material into the core cavity to form the core; and a second sprue defined in the mold and communicating with the main cavity for injecting a melted material into the main cavity to form the engine casing.

2. The mold as claimed in claim 1, wherein the first sprue and the second sprue communicate with each other.

3. The mold as claimed in claim 1, wherein:

the core cavity comprises a connecting portion extending to communicate with the groove of the first core, three recesses defined in an inner periphery of the core cavity and three channels each defined to communicate with a corresponding one of the three recesses in the core cavity; and the core comprises a stub formed in the connecting portion, three connectors respectively integrally extending from the stub and respectively formed in a corresponding one of the three channels and three blocks each integrally formed on a free end of a corresponding one of the three connectors and formed in a corresponding one of the three recesses in the core cavity.

4. The mold as claimed in claim 2, wherein:

the core cavity comprises a connecting portion extending to communicate with the groove of the first core, three recesses defined in an inner periphery of the core cavity and three channels each defined to communicate with a corresponding one of the three recesses in the core cavity; and the core comprises a stub formed in the connecting portion, three connectors respectively integrally extending from the stub and respectively formed in a corresponding one of the three channels and three blocks each integrally formed on a free end of a corresponding one of the three connectors and formed in a corresponding one of the three recesses in the core cavity.

5. A method for producing a two-stroke engine casing of a radio control model, comprising multiple steps as follows:

a. dipping a first core in a releasing agent;

b. mounting the fist core in a first core cavity of a mold to define a core cavity;

c. injecting a melted material to form in the core cavity a core;

d. detaching the first core with the core from the core cavity;

e. dipping the first core and the core in the releasing agent;

f. mounting the first core and the core in a main cavity to define in the mold an engine casing forming space;

g. mounting a second core, a third core, a fourth core and a fifth core in the mold;

h. dipping in the releasing agent and mounting an additional first core in the first core cavity;

i. injecting a melted material to concurrently form the engine casing in the space in the main cavity and an additional core in the core cavity;

j. detaching the first core from the core disposed in the engine casing; and k. breaking and removing the core from the engine casing.

6. The method as claimed in claim 5, wherein the first core detached from the core at step j is subsequently re-used as the additional fist core at step h.

7. A method for producing a two-stroke engine casing of a radio control model, comprising the steps of:

a. dipping a first core in a releasing agent;

b. mounting the first core in a first core cavity of a mold to define a core cavity;

c. injecting a melted material to fill and form in the core cavity a core, the core being integrally joined to extend from an end of the first core, the core having extending therefrom a plurality of connector portions each terminating at a block portion;

d. detaching the first core with the integrally joined core from the core cavity;

e. dipping the first core with the integrally joined core in the releasing agent;

f. mounting the first core with the integrally joined core in a main cavity to define in the mold an engine casing forming space;

g. dipping in the releasing agent and mounting an additional first core in the first core cavity;

h. injecting a melted material to concurrently form the engine casing in the space in the main cavity and an additional core in the core cavity;

i. separating the first core from the core disposed in the engine casing;

j. breaking the connector portions of the core in the engine casing; and, k. detaching the block portions from the engine casing.

* * * * *